US010096887B2

(12) United States Patent
Gu et al.

(10) Patent No.: US 10,096,887 B2
(45) Date of Patent: Oct. 9, 2018

(54) MOBILE DEVICE WITH TRI-BAND ANTENNAS INCORPORATED INTO A METAL BACK SIDE

(71) Applicant: BLACKBERRY LIMITED, Waterloo (CA)

(72) Inventors: Huanhuan Gu, Kitchener (CA); Shirook M. Ali, Milton (CA)

(73) Assignee: BLACKBERRY LIMITED, Waterloo, Ontario ( * ) Notice: Subject to any disclaimer, the term of this patent is extended or adjusted under 35 U.S.C. 154(b) by 218 days.

(21) Appl. No.: 14/486,632

(22) Filed: Sep. 15, 2014

(65) Prior Publication Data

US 2016/0079652 A1 Mar. 17, 2016

(51) Int. Cl.

| | |
|---|---|
| ***H01Q 1/52*** | (2006.01) |
| ***H01Q 1/24*** | (2006.01) |
| ***H01Q 9/04*** | (2006.01) |
| ***H01Q 21/28*** | (2006.01) |
| ***H01Q 21/30*** | (2006.01) |
| ***H01Q 5/371*** | (2015.01) |
| ***H01Q 21/00*** | (2006.01) |

(52) U.S. Cl.

CPC ..... *H01Q 1/243* (2013.01); *H01Q 5/371* (2015.01); *H01Q 9/0421* (2013.01); *H01Q 21/0006* (2013.01); *H01Q 21/28* (2013.01); *H01Q 21/30* (2013.01); *H01Q 1/521* (2013.01)

(58) Field of Classification Search

CPC ..... H01Q 1/2258; H01Q 1/364; H01Q 1/371; H01Q 1/52; H01Q 1/521; H01Q 1/526; H01Q 5/364; H01Q 5/371; H01Q 25/00; H01Q 1/241–1/245; H01Q 9/0421; H01Q 21/30; H01Q 21/28; H01Q 1/48; H01Q 1/50; H01Q 5/378; H01Q 9/42; H01Q 13/10; H01Q 5/321; H01Q 5/328

USPC ..... 343/702, 841

See application file for complete search history.

(56) References Cited

U.S. PATENT DOCUMENTS

| | | | | |
|---|---|---|---|---|
| 7,183,983 | B2 * | 2/2007 | Ozden | H01Q 1/243 343/700 MS |
| 8,754,817 | B1 * | 6/2014 | Kuo | H01Q 1/243 343/700 MS |
| 9,002,262 | B1 * | 4/2015 | Kuo | H01Q 1/50 343/702 |

(Continued)

OTHER PUBLICATIONS

The ARRL Antenna Book, by Gerald (Jerry) Hall, 1988.*

Extended European Search Report dated Feb. 2, 2016 for European Patent Application No. 15184731.6.

*Primary Examiner* — Hoang Nguyen
*Assistant Examiner* — Awat Salih
(74) *Attorney, Agent, or Firm* — Perry+Currier Inc.

(57) ABSTRACT

A mobile device with tri-band antennas incorporated into a metal back side thereof is provided. The device comprises: a back side comprising a face and opposing ends; an edge extending from the face: a conducting central portion; antennas located at the opposing ends, each of the antennas electrically separated from the conducting central portion, and each comprising: a first respective radiating arm located at least partially on the face, and at least two further respective radiating arms extending from the first respective radiating arm, the at least two further respective radiating arms located on the edge, the radiating arms configured to resonate in at least three frequency ranges; one or more antenna feeds connected to each of the antennas; and, a switch configured to select one or more of the antennas for operation.

15 Claims, 6 Drawing Sheets

(56) References Cited

U.S. PATENT DOCUMENTS

2004/0227683 A1* 11/2004 Caimi ..... H01Q 1/36 343/742
2005/0270240 A1* 12/2005 Qi ..... H01Q 1/243 343/702
2009/0153407 A1* 6/2009 Zhang ..... H01Q 1/243 343/702
2010/0053002 A1* 3/2010 Wojack ..... H01Q 9/42 343/702
2011/0043408 A1* 2/2011 Shi ..... H01Q 9/0421 343/700 MS
2011/0057858 A1* 3/2011 Yan ..... B29C 45/0053 343/878
2012/0112969 A1* 5/2012 Caballero ..... H01Q 1/243 343/702
2012/0112970 A1* 5/2012 Caballero ..... H01Q 1/243 343/702
2012/0176278 A1* 7/2012 Merz ..... H01Q 1/243 343/702
2012/0229347 A1* 9/2012 Jin ..... H01Q 1/243 343/702
2012/0268345 A1* 10/2012 Bungo ..... H01Q 1/243 343/893
2012/0299785 A1* 11/2012 Bevelacqua ..... H01Q 9/42 343/702
2013/0069836 A1* 3/2013 Bungo ..... H01Q 1/243 343/724
2013/0154886 A1* 6/2013 Isohatala ..... H01Q 1/243 343/702
2013/0194143 A1* 8/2013 Bungo ..... H01Q 21/28 343/725
2013/0257659 A1* 10/2013 Darnell ..... H01Q 1/243 343/702
2014/0125528 A1* 5/2014 Tsai ..... H01Q 13/106 343/702
2014/0139380 A1* 5/2014 Ouyang ..... H01Q 7/00 343/702
2014/0162719 A1* 6/2014 Han ..... H04W 88/06 455/552.1
2014/0266922 A1* 9/2014 Jin ..... H01Q 21/28 343/702
2014/0327584 A1* 11/2014 Chang ..... H01Q 5/378 343/702
2014/0340281 A1* 11/2014 Chang ..... H01Q 1/22 343/906
2015/0002340 A1* 1/2015 Liou ..... H01Q 7/00 343/700 MS
2016/0064801 A1* 3/2016 Han ..... H01Q 1/243 343/702
2016/0164169 A1* 6/2016 Krogerus ..... H01Q 1/36 343/702

* cited by examiner

| FS | | | | | |
|---|---|---|---|---|---|
| | 698-790 | 790-920 | 920-960 | 1700-2200 | 2300-2700 |
| Ant 1 | -3 | -3.5 | -4 | -4 | -1.5 |
| Ant 2 | -5 | -5 | -4 | -4 | -6 |
| Spec | -5 | -3.5 | -6 | -3 | -3 |
| Cable loss | 1 | 1 | 1 | 1 | 1 |
| Potential antenna | ant 1 | ant 1 | ant 1 or 2 | ant 1 or 2 | ant 1 |

| LHH | | | | | |
|---|---|---|---|---|---|
| | 698-790 | 790-920 | 920-960 | 1700-2200 | 2300-2700 |
| Ant 1 | -14 | -14 | -12 | -8 | -10 |
| Ant 2 | -9 | -8 | -8 | -8 | -9 |
| Spec | -13 | -12 | -12 | -8 | -9 |
| Cable loss | 1 | 1 | 1 | 1 | 1 |
| Potential antenna | ant 2 | ant 2 | ant 2 | ant 1 or 2 | ant 2 |

146

FIG. 6

MOBILE DEVICE WITH TRI-BAND ANTENNAS INCORPORATED INTO A METAL BACK SIDE

FIELD

The specification relates generally to antennas, and specifically to a mobile device with tri-band antennas incorporated into a metal back side thereof.

BACKGROUND

A MIMO (multiple-input and multiple-output) antenna design of a partial metal housing for 4G handset applications generally includes the antenna working at low, mid and high frequencies (e.g. tri-band), for example, with a low band being a range of 710-960 MHz, a medium band being in a range of 1710-2100 MHz, and high band being in a range of 2300-2600 MHz. The tri-band design can effectively reduce the number of antennae used in mobile applications. However, MIMO tri-band antenna technology in partial metal housing handsets can be challenging as such tri-band antennas should fit into a partial metal back compact phone with multi-operating frequencies, and good diversity and capacity performance. However, the partial metal back can interfere with the antenna; hence, when the tri-band antennas are put in the partial metal back handset, their performance deteriorates.

BRIEF DESCRIPTIONS OF THE DRAWINGS

For a better understanding of the various implementations described herein and to show more clearly how they may be carried into effect, reference will now be made, by way of example only, to the accompanying drawings in which:

FIG. 6 depicts an antennas selection table for use in the device of FIG. 1, according to non-limiting implementations.

DETAILED DESCRIPTION

Figure 1:
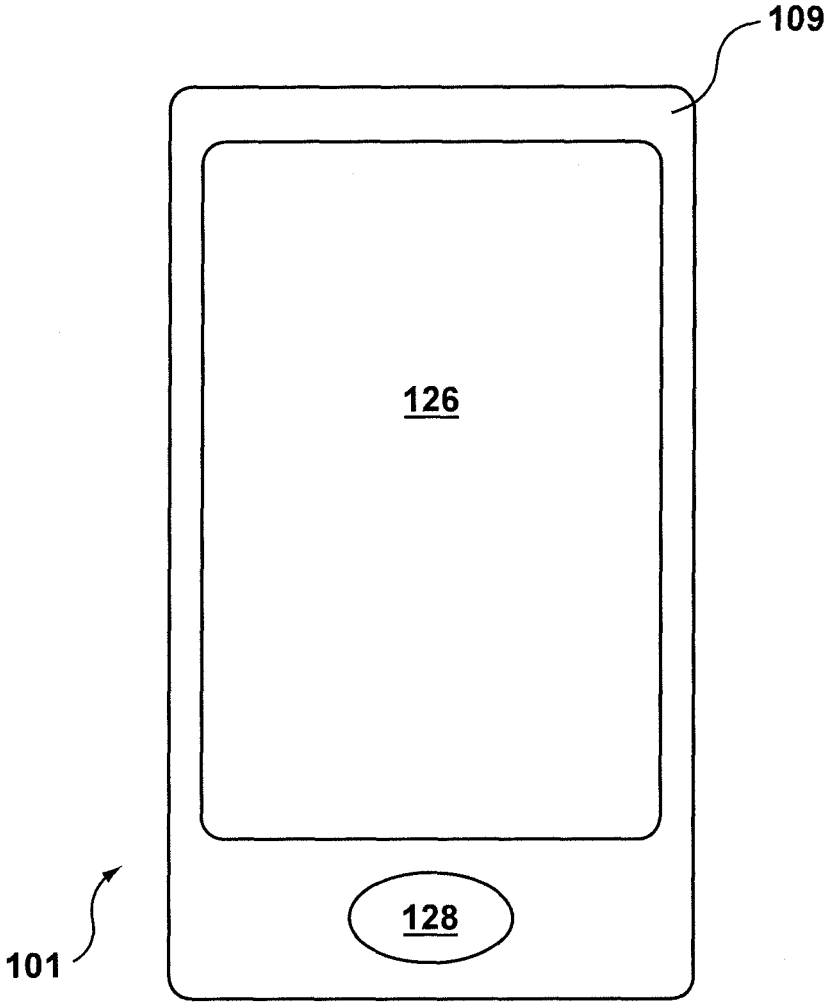
FIG. 1 depicts a front perspective view of a device that includes a multi-antenna system for mobile handsets with at least a partially metallic back side, according to non-limiting implementations.

The present disclosure describes examples of devices with a predominantly metal and/or predominantly conducting back side, that includes tri-band antennas on either end, a first radiating arm located at least partially on a face of the back side and two shorter radiating arms extending from the first radiating arm along an edge and/or side of the back side that extends from the face. Each tri-band antenna can resonate in three different frequency ranges including, but not limited to, 710-960 MHz, 1710-2100 MHz and 2300-2600 MHz. And a switch in the device can switch between the antennas, and/or cause both antennas to operate at the same time depending on whether the device is in an uplink mode or a downlink mode, and/or based on an antenna selection table stored in a memory of the device.

In this specification, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

Furthermore, as will become apparent, in this specification certain elements may be described as connected physically, electronically, or any combination thereof, according to context. In general, components that are electrically connected are configured to communicate (that is, they are capable of communicating) by way of electric signals. According to context, two components that are physically coupled and/or physically connected may behave as a single element. In some cases, physically connected elements may be integrally formed, e.g., part of a single-piece article that may share structures and materials. In other cases, physically connected elements may comprise discrete components that may be fastened together in any fashion. Physical connections may also include a combination of discrete components fastened together, and components fashioned as a single piece.

Furthermore, as will become apparent in this specification, certain antenna components may be described as being configured for generating a resonance at a given frequency and/or resonating at a given frequency and/or having a resonance at a given frequency. In general, an antenna component that is configured to resonate at a given frequency, and the like, can also be described as having a resonant length, a radiation length, a radiating length, an electrical length, and the like, corresponding to the given frequency. The electrical length can be similar to, or different from, a physical length of the antenna component. The electrical length of the antenna component can be different from the physical length, for example by using electronic components to effectively lengthen the electrical length as compared to the physical length. The term electrical length is most often used with respect to simple monopole and/or dipole antennas. The resonant length can be similar to, or different from, the electrical length and the physical length of the antenna component. In general, the resonant length corresponds to an effective length of an antenna component used to generate a resonance at the given frequency; for example, for irregularly shaped and/or complex antenna components that resonate at a given frequency, the resonant length can be described as a length of a simple antenna component, including but not limited to a monopole antenna and a dipole antenna, that resonates at the same given frequency.

The present specification provides a device comprising: a back side comprising a face; a first end, and a second end opposite the first end; an edge extending from the face that encircles the face: a conducting central portion located on the face; a first antenna located at the first end; a second antenna located at the second end, each of the first antenna and the second antenna electrically separated from the conducting central portion, and each of the first antenna and the second antenna comprising: a first respective radiating arm located at least partially on the face, and at least two further respective radiating arms extending from the first respective radiating arm, the at least two further respective radiating arms located on the edge, the first respective radiating arm and the at least two further respective radiating arms configured to resonate in at least three frequency ranges; one or more antenna feeds connected to each of the first antenna and the second antenna; and, a switch configured to select one or more of the first antenna and the second antenna for operation.

Each of conducting central portion, the first antenna and the second antenna can comprises one or more metals.

Each of the first antenna and the second antenna can comprise one or more metals.

The back side can comprise one or more of an entire metal piece and a predominantly metal piece, forming each of the conducting central portion, the first antenna and the second antenna, with each of the each of the conducting central portion, the first antenna and the second antenna separated by one or more non-conducting materials.

The back side can further comprise a non-conducting chassis, the conducting central portion comprising a conducting sheet attached to the non-conducting chassis, the first antenna and the second antenna each comprising one or more respective microstrips on the non-conducting chassis.

Each of the first antenna and the second antenna can further comprise: a first respective connection to the one or more antenna feeds; and a second respective connection to a ground plane.

The device can further comprise one or more antenna shorting-to-ground pins connected to each of the first antenna and the second antenna.

The device can further comprise a port through an end of the device adjacent the first antenna, the first antenna clearing the port.

The device can further comprise a memory storing an antenna selection table, and the switch can be further configured to select one or more of the first antenna and the second antenna for operation based upon the antenna selection table.

The switch can be further configured to select one or more of the first antenna and the second antenna for transmission operation.

The conducting central portion can cover about 80% of the back side.

The first respective radiating arm can extend from side-to-side of the face at a respective end of the face.

The first respective radiating arm can extends from side-to-side of the face at a respective end of the face and can further wrap around to the edge, each of the at least two further respective radiating arms extending from an edge portion of the first respective radiating arm.

At least a portion of a perimeter of the first respective radiating arm can have a shape similar to a respective end of the face.

Each of the at least two further respective radiating arms can extend from opposite ends of the first respective radiating arm.

Each of the at least two further respective radiating arms can extend towards each other from opposite ends of the first respective radiating arm.

The first respective radiating arm can be configured to resonate in a frequency range lower than respective frequency ranges of the at least two further respective radiating arms.

The first respective radiating arm can be configured to resonate in one or more of: a frequency range of about 698 MHz to about 960 MHz; an LTE (Long-Term Evolution) frequency range; and LTE700 frequency range.

A first radiating arm of the at least two further respective radiating arms can be configured to resonate in one or more of: a frequency range of about 1710 to about 2100 MHz, a GSM (Global System for Mobile Communications) frequency range; a CDMA (Code Division Multiple Access) frequency range; a PCS (Personal Communications Service) frequency range; and a UMTS (Universal Mobile Telecommunications System) frequency range. A second radiating arm of the at least two further respective radiating arms can be configured to resonate in one or more of: a frequency range of about 2300 to about 2700 MHz, another GSM (Global System for Mobile Communications) frequency range; another CDMA (Code Division Multiple Access) frequency range; another PCS (Personal Communications Service) frequency range; and another UMTS (Universal Mobile Telecommunications System) frequency range.

A first one of the at least three frequency ranges can comprise one or more of: a frequency range of about 698 MHz to about 960 MHz; an LTE (Long-Term Evolution) frequency range; and LTE700 frequency range; a second one of the at least three frequency ranges can comprise one or more of: about 1710 to about 2100 MHz, a GSM (Global System for Mobile Communications) frequency range; a CDMA (Code Division Multiple Access) frequency range; a PCS (Personal Communications Service) frequency range; and a UMTS (Universal Mobile Telecommunications System) frequency range; and, a third one of the at least three frequency ranges can comprise one or more of: about 2300 to about 2700 MHz, another GSM (Global System for Mobile Communications) frequency range; another CDMA (Code Division Multiple Access) frequency range; another PCS (Personal Communications Service) frequency range; and another UMTS (Universal Mobile Telecommunications System) frequency range.

Figure 2:
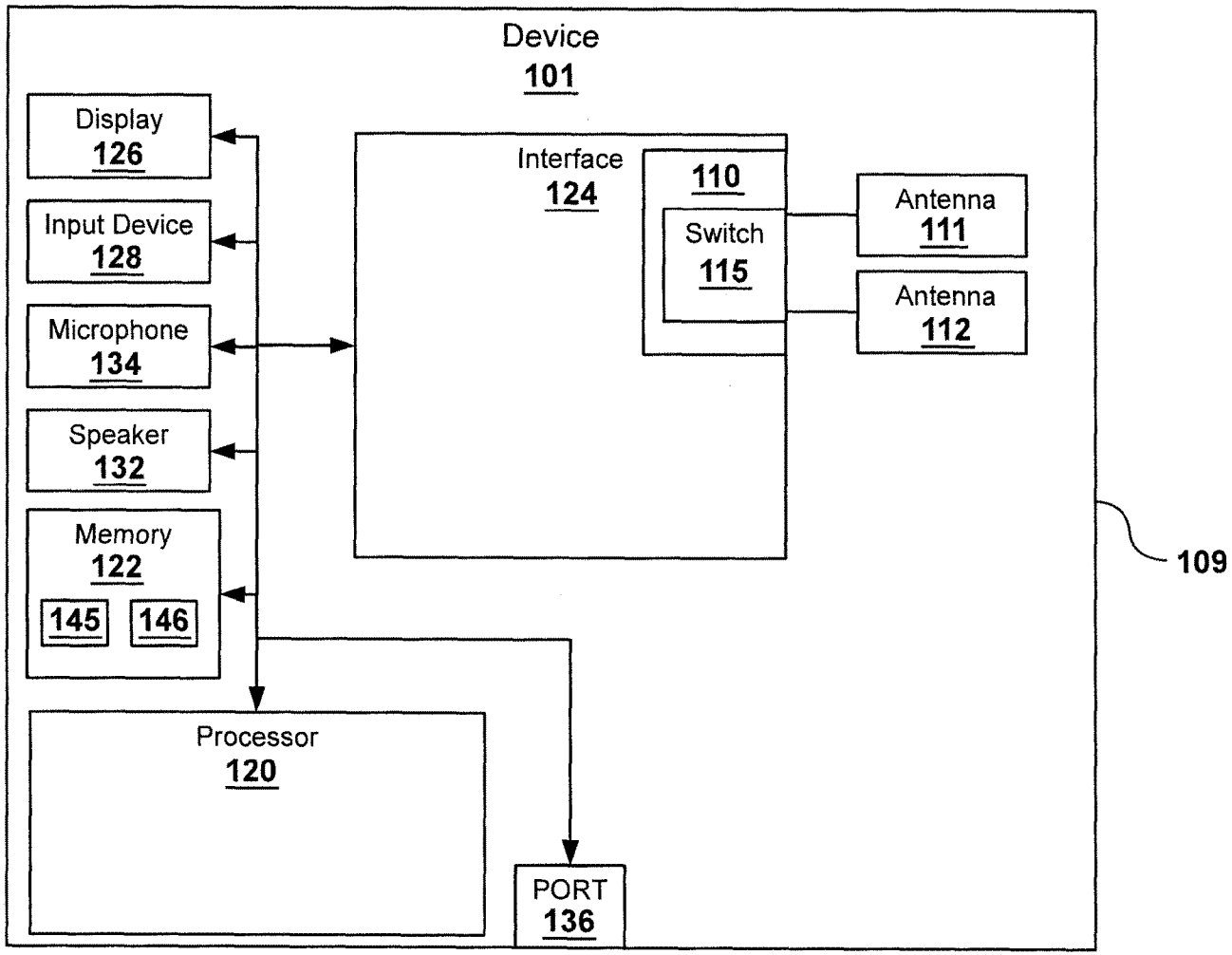
FIG. 2 depicts a schematic diagram of the device of FIG. 1, according to non-limiting implementations.

FIGS. 1 and 2 respectively depict a front perspective view and a schematic diagram of a mobile electronic device 101, referred to interchangeably hereafter as device 101. Device 101 comprises: a chassis 109; one or more antenna feeds 110, a first antenna 111, and a second antenna 112; and a switch 115 configured to select one or more of first antenna 111 and second antenna 112 for operation. Physical configurations of device 101 and antennas 111, 112 will be described in further detail below.

Device 101 can be any type of electronic device that can be used in a self-contained manner to communicate with one or more communication networks using antennas 111, 112. Device 101 can include, but is not limited to, any suitable combination of electronic devices, communications devices, computing devices, personal computers, laptop computers, portable electronic devices, mobile computing devices, portable computing devices, tablet computing devices, laptop computing devices, desktop phones, telephones, PDAs (personal digital assistants), cellphones, smartphones, e-readers, internet-enabled appliances and the like. Other suitable devices are within the scope of present implementations. Device hence further comprise a processor 120, a memory 122, a display 126, a communication interface 124 that can optionally comprise antenna feed 110 and/or switch 115, at least one input device 128, a speaker 132 and a microphone 134.

It should be emphasized that the shape and structure of device 101 in FIGS. 1 and 2 are purely examples, and contemplate a device that can be used for both wireless voice (e.g. telephony) and wireless data communications (e.g. email, web browsing, text, and the like). However, FIG. 1 contemplates a device that can be used for any suitable specialized functions, including, but not limited, to one or more of, telephony, computing, appliance, and/or entertainment related functions.

With reference to FIG. 1, an exterior of device 101 is depicted with a front portion of chassis 109, the corners of chassis 109 being generally square though, in other implementation, the corners can be rounded and/or any other suitable shape; indeed, the shape and configuration of device 101 depicted in FIG. 1 is merely an example and other shapes and configurations are within the scope of present implementations.

With reference to FIGS. 1 and 2, device 101 comprises at least one input device 128 generally configured to receive input data, and can comprise any suitable combination of input devices, including but not limited to a keyboard, a keypad, a pointing device (as depicted in FIG. 1), a mouse, a track wheel, a trackball, a touchpad, a touch screen and the like. Other suitable input devices are within the scope of present implementations.

Input from input device 128 is received at processor 120 (which can be implemented as a plurality of processors, including but not limited to one or more central processors (CPUs)). Processor 120 is configured to communicate with a memory 122 comprising a non-volatile storage unit (e.g. Erasable Electronic Programmable Read Only Memory ("EEPROM"), Flash Memory) and a volatile storage unit (e.g. random access memory ("RAM")). Programming instructions that implement the functional teachings of device 101 as described herein are typically maintained, persistently, in memory 122 and used by processor 120 which makes appropriate utilization of volatile storage during the execution of such programming instructions. Those skilled in the art will now recognize that memory 122 is an example of computer readable media that can store programming instructions executable on processor 120. Furthermore, memory 122 is also an example of a memory unit and/or memory module.

Memory 122 further stores an application 145 that, when processed by processor 120, enables processor 120 to control switch 115 to switch between antennas 111, 112. Furthermore, memory 122 storing application 145 is an example of a computer program product, comprising a non-transitory computer usable medium having a computer readable program code adapted to be executed to implement a method, for example a method stored in application 145.

Memory 122 can further store an antenna selection table 146 that can be processed by processor 120 so that a decision can be made as to which antenna 111, 112 to operate, so that switch 115 can be controlled accordingly. For example, switch 115 can be configured to select one or more of first antenna 111 and second antenna 112 for operation and/or transmission operation. Antenna selection table 146 is described in further detail below.

Processor 120 can be further configured to communicate with display 126, and microphone 134 and speaker 132. Display 126 comprises any suitable one of, or combination of, flat panel displays (e.g. LCD (liquid crystal display), plasma displays, OLED (organic light emitting diode) displays, capacitive or resistive touchscreens, CRTs (cathode ray tubes) and the like. Microphone 134 comprises any suitable microphone for receiving sound and converting to audio data. Speaker 132 comprises any suitable speaker for converting audio data to sound to provide one or more of audible alerts, audible communications from remote communication devices, and the like. In some implementations, input device 128 and display 126 are external to device 101, with processor 120 in communication with each of input device 128 and display 126 via a suitable connection and/or link.

Processor 120 also connects to communication interface 124 (interchangeably referred to as interface 124), which can be implemented as one or more radios and/or connectors and/or network adaptors, configured to wirelessly communicate with one or more communication networks (not depicted) via antennas 111, 112. It will be appreciated that interface 124 is configured to correspond with network architecture that is used to implement one or more communication links to the one or more communication networks, including but not limited to any suitable combination of USB (universal serial bus) cables, serial cables, wireless links, cell-phone links, cellular network links (including but not limited to 2G, 2.5G, 3G, 4G+ such as UMTS (Universal Mobile Telecommunications System), GSM (Global System for Mobile Communications), CDMA (Code division multiple access), FDD (frequency division duplexing), LTE (Long Term Evolution), TDD (time division duplexing), TDD-LTE (TDD-Long Term Evolution), TD-SCDMA (Time Division Synchronous Code Division Multiple Access) and the like, wireless data, Bluetooth™ links, NFC (near field communication) links, WLAN (wireless local area network) links, WiFi links, WiMax links, packet based links, the Internet, analog networks, the PSTN (public switched telephone network), access points, and the like, and/or a combination.

Specifically, interface 124 comprises radio equipment (i.e. a radio transmitter and/or radio receiver) for receiving and transmitting signals using antennas 111, 112. It is further appreciated that, as depicted, interface 124 comprises antenna feed 110 and switch 115, which alternatively can be separate from interface 124 and/or separate from each other.

As depicted, device 101 further comprises a port 136 which can include, but is not limited to a USB (Universal Serial Bus) port.

While not depicted, device 101 can further comprise a ground plane that can be connected to one or more of antennas 111, 112.

While also not depicted, device 101 further comprises a power source, not depicted, for example a battery or the like. In some implementations the power source can comprise a connection to a mains power supply and a power adaptor (e.g. an AC-to-DC (alternating current to direct current) adaptor).

In any event, it should be understood that a wide variety of configurations for device 101 are contemplated.

Furthermore, each of antennas 111, 112 can be configured to resonate in at least three frequency bands. A first one of the at least three frequency ranges can comprise one or more of: a frequency range of about 698 MHz to about 960 MHz; an LTE (Long-Term Evolution) frequency range; and LTE700 frequency range. A second one of the at least three frequency ranges can comprise one or more of: about 1710 to about 2100 MHz, a GSM (Global System for Mobile Communications) frequency range; a CDMA (Code Division Multiple Access) frequency range; a PCS (Personal Communications Service) frequency range; and a UMTS (Universal Mobile Telecommunications System) frequency range. A third one of the at least three frequency ranges comprises one or more of: about 2300 to about 2700 MHz, another GSM (Global System for Mobile Communications) frequency range; another CDMA (Code Division Multiple Access) frequency range; another PCS (Personal Communications Service) frequency range; and another UMTS (Universal Mobile Telecommunications System) frequency range.

In other words, each antenna 111, 112 can comprises a MIMO (multiple-in-multiple-out) tri-band antenna.

Figure 3:
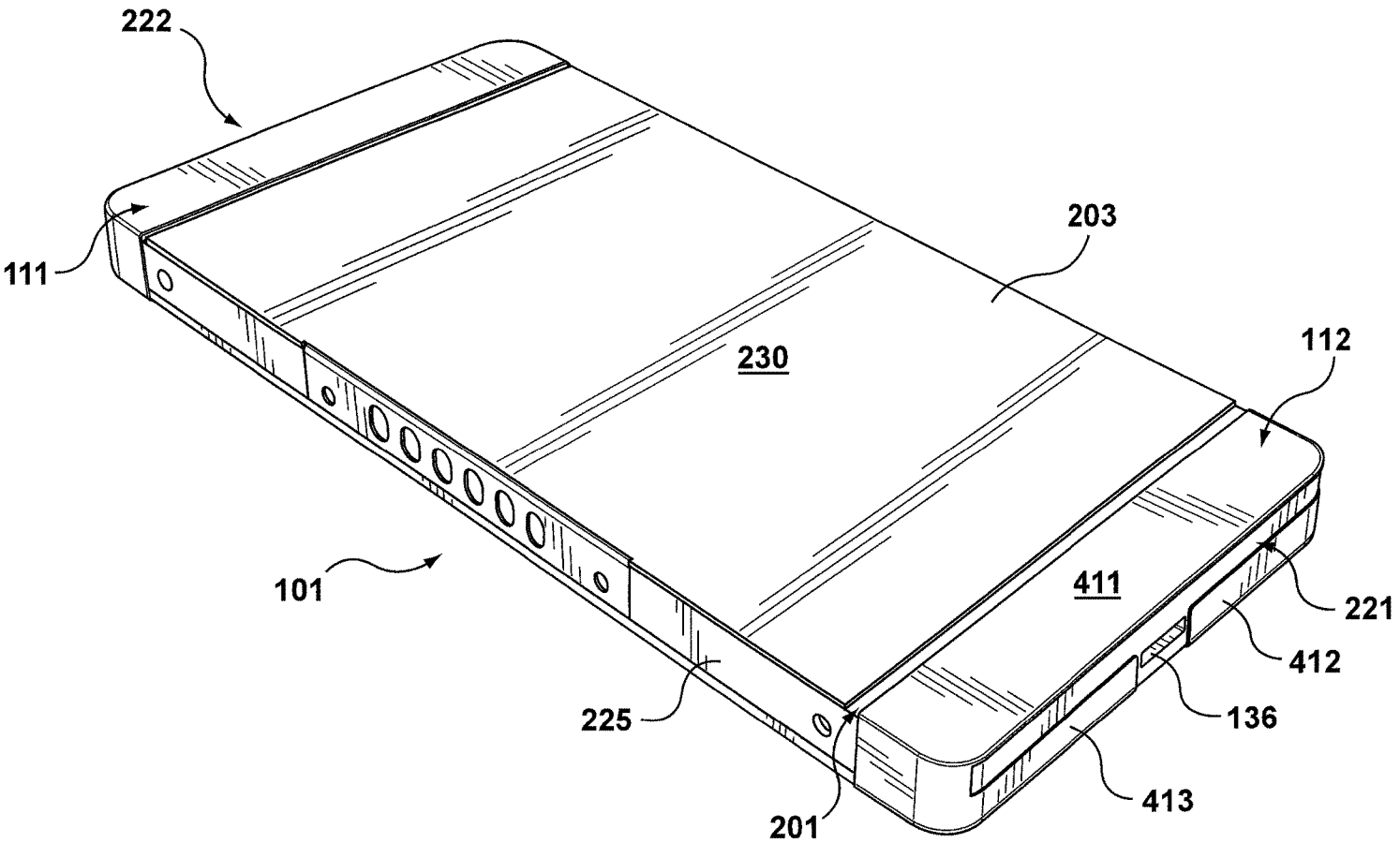
FIG. 3 depicts an exterior perspective view of a back side of the device of FIG. 1, according to non-limiting implementations.
Figure 4:
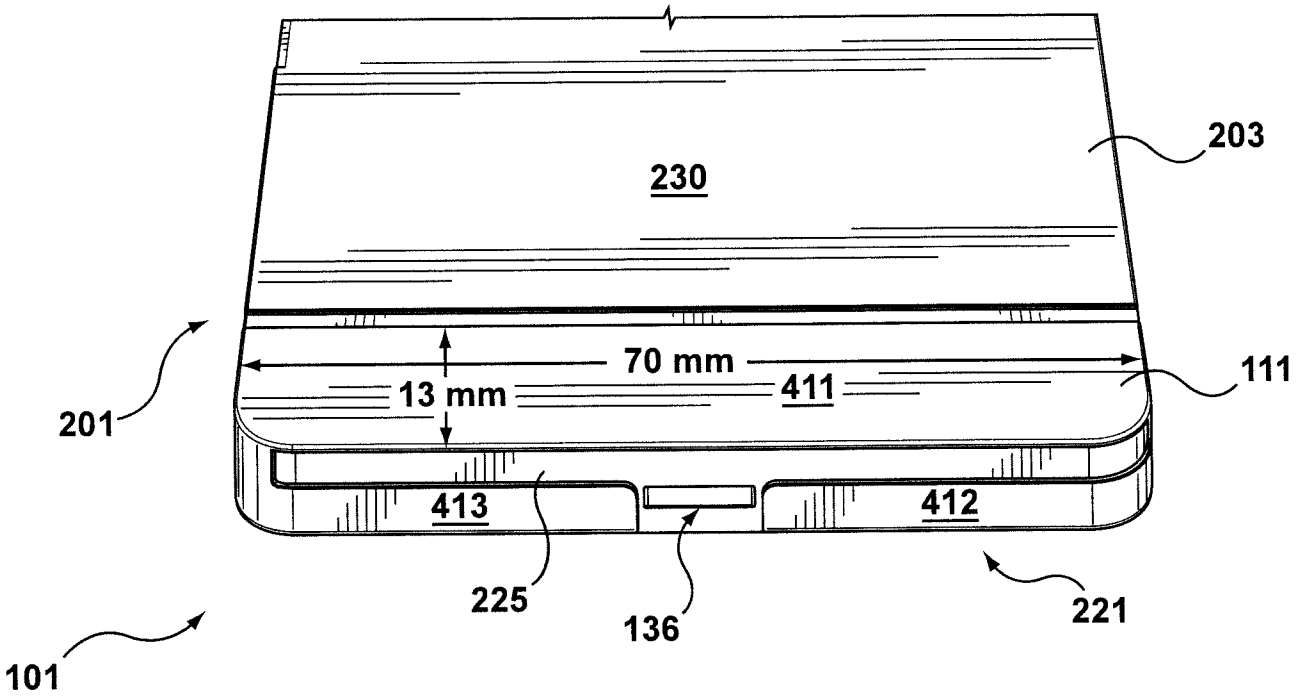
FIG. 4 depicts a perspective view of an end of the device of FIG. 1, including a tri-band antenna, according to non-limiting implementations.
Figure 5:
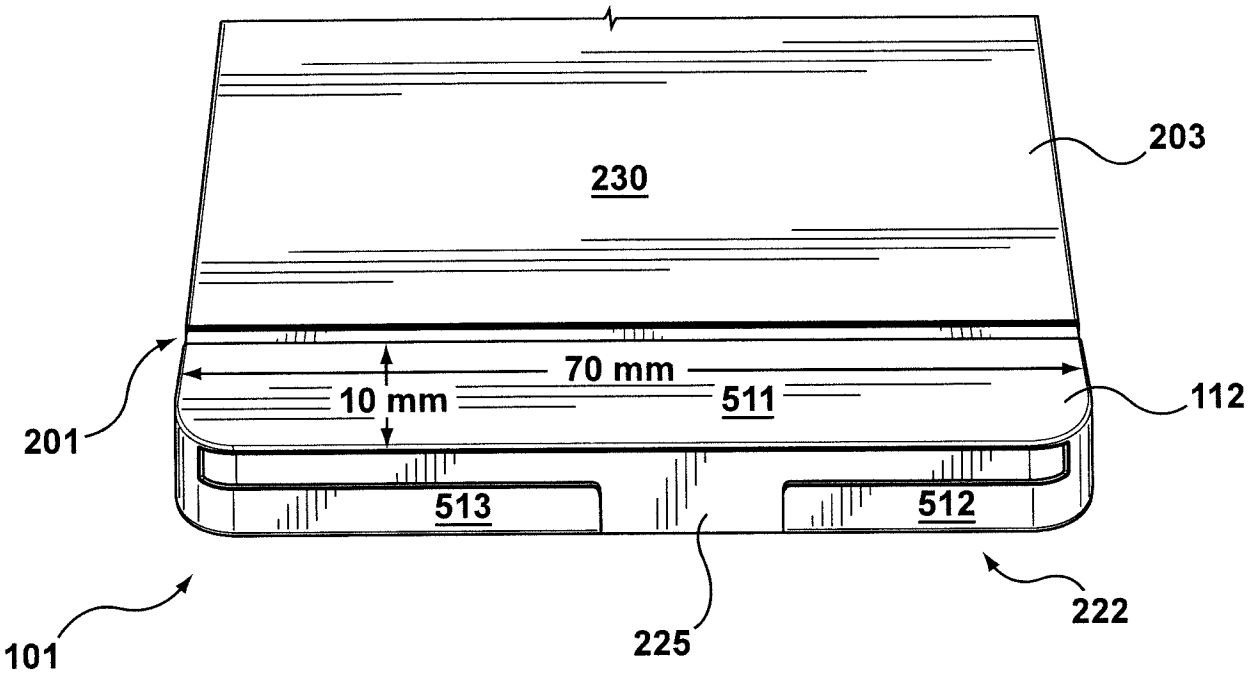
FIG. 5 depicts a perspective view of an opposite end of the device of FIG. 1 as that in FIG. 4, including another tri-band antenna, according to non-limiting implementations.

Physical configurations of device 101, antennas 111, 112 are next described in detail with references to FIGS. 3 through 5.

Attention is next directed to FIG. 3 which depicts a perspective view of a back side 201 of device 101. Back side 201 can comprise a component of chassis 109, and is generally attachable to a remaining portion of device 101, including, but not limited to, a front portion of chassis 109 depicted in FIG. 1 and/or an internal chassis. For example, back side 201 can include a back cover (not depicted) that can be removably attached to device 101 so that a battery of device 101 can be accessed.

In any event, back side 201 comprises a face 203, a first end 221 and a second end 222 opposite first end 221, and an edge 225 extending from face 203 that encircles face 203. For example, edge 225 can be about perpendicular to face 203 and extend from face 203 to a front side of device 101, for example as depicted in FIG. 1. Furthermore each end 221, 222 can include at least a portion of face 203 and a portion of edge 225.

As can also be seen in FIG. 3, device 101 further comprises: a conducting central portion 230 located on face 203. As can also be seen in FIG. 3, first antenna 111 is located at first end 221, and second antenna 112 is located at second end 222, each of first antenna 111 and second antenna 112 electrically separated from conducting central portion 230, and each of the first antenna and the second antenna comprising: a first respective radiating arm 411 located at least partially on face 203, and at least two further respective radiating arms 412, 413 extending from the first respective radiating arm 411, the at least two further respective radiating arms 412, 413 located on edge 225, the first respective radiating arm 411 and the at least two further respective radiating arms 412, 413 configured to resonate in at least three frequency ranges. In general, one or more antenna feeds 110 are connected to each of first antenna 111 and second antenna 112; and, switch 115 is configured to select one or more of first antenna 111 and second antenna 112 for operation, as described in further detail below.

Conducting central portion 230 can comprise one or more conducting materials, including, but not limited to, one or more metals. However, conducting plastics, conducting polymers, and the like are within the scope of present implementations.

In some implementations at least a portion of back side 201 can comprise a back cover which can be removable and/or flexible so that one or more latches, hooks, and the like of the back cover can be undone to remove the back cover from device 101, for example to replace a battery.

In some implementations, back side 201 can further comprise a non-conducting chassis, conducting central portion 230 comprising a conducting sheet attached to the non-conducting chassis, first antenna 111 and second antenna 112 each comprising one or more respective microstrips on the non-conducting chassis, with connections (not depicted) to antennas feeds 110, and optionally a ground plane, through the non-conducting chassis to each of antennas 111, 112. Indeed, in specific non-limiting implementations, device 101 comprises one or more antenna shorting-to-ground pins connected to each of first antenna 111 and second antenna 112. For example, an antenna feed 110 can be connected to one of radiating arms 412, 413, and a shorting-to-ground pin connected to the other of radiating arms 412, 413. However, other structures of back side 201 are within the scope of present implementations; for example, each end 221, 222 can comprise non-conducting caps connected to a central non-conducting chassis using any combination of attachment devices, glues, and the like, the caps being removable in some implementations, at least during manufacture of device 101, with antennas 111, 112 located on the caps, with connections (not depicted) to antennas feeds 110, and optionally a ground plane, through the caps to each of antennas 111, 112. Hence, while not depicted, regardless of the configuration of device 101, each of first antenna 111 and second antenna 112 further comprise: a first respective connection to one more antenna feeds 110; and a second respective connection to a ground plane.

In yet further implementations, each of conducting central portion 230 and antennas 111, 112 can comprise metal so that the back side 201 comprises a predominantly metal back side of device 101. Indeed, in some of these implementations, back side 201 comprises a predominantly metal piece, with conducting central portion 230 and antennas 111, 112 separated by non-conducting material. Hence, each of conducting central portion 230, first antenna 111 and second antenna 112 can comprise one or more metals and/or each of first antenna 111 and second antenna 112 can comprise one or more metals (e.g. face 203 can be metal or non-metal). In yet further implementations, back side 201 can comprise one or more of an entire metal piece and a predominantly metal piece, forming each of conducting central portion 230, first antenna 111 and second antenna 112, with each of the each of conducting central portion 230, first antenna 111 and second antenna 112 separated by one or more non-conducting materials. Such selections and/or choices of materials for each of conducting central portion 230, first antenna 111 and second antenna 112 can be based on a combination of aesthetics (e.g. based on market forces) and antenna performance. For example, a metal-based back side can be an aesthetic goal, with dimensions and/or material selection etc. of conducting central portion 230, first antenna 111 and second antenna 112 based on antenna performance.

In some implementations, as depicted, conducting central portion 230 covers about 80% of back side 201. However, in other implementations, conducting central portion 230 can cover more or less than 80% of back side 201. Furthermore, in some implementations, as depicted, a portion of conducting central portion 230 can at least partially wrap around edge 225. However, each antenna 111, 112 is of a size that enables each of antennas 111, 112 to resonate within a specification in the operating frequency ranges; in other words, a size of conducting central portion 230 can selected so as to not interfere with operation of each of antennas 111, 112. In addition, there is a respective gap between conducting central portion 230 and each of antennas 111, 112. For example each gap can be about 1 mm, though the size of the gap can be selected for aesthetics and so that conducting central portion 230 does not interfere with operation of each of antennas 111, 112. In some implementations, conducting central portion 230, and/or antennas 111, 112 can be recessed into the non-conducting chassis with gaps there between comprising material of the non-conducting chassis. In other words, the gaps between conducting central portion 230 and antennas 111, 112 can comprise an electrical gap but not an absence of material there between.

As depicted, device further comprises port 136 through end 221 of device 101, adjacent first antenna 111, however first antenna 111 generally clears (e.g. does not overlap) port 136. In other words, the radiating arms 412, 413 of first antenna 111 located on edge 225 extend towards port 136 but do not overlap port 136, which generally comprises an aperture through end 221.

Structure of antenna 111 is next described with reference to both FIG. 3, and FIG. 4, which depicts a perspective view of end 221 showing antenna 111 in detail, as well as dimensions of a successful prototype of antenna 111. In these implementations, back 201 comprises a plastic substrate with a thickness of about 6 mm at end 221 upon which antenna 111 is mounted. For example, antenna 111 can comprise one or more microstrips of a conducting material mounted on the plastic substrate, the conducting material including, but not limited to metal, metal foil, copper, conducting plastic, conducting polymer and the like. The microstrips can be connected using solder, conducting paste and/or conducting glue and/or antenna 112 can have an integrated structure. Port 136 is also visible in FIG. 4, first antenna 111 clearing port 136.

In any event, as seen in FIGS. 3 and 4, first respective radiating arm 411 extends from side-to-side of face 203 at a respective end 221 of face 203. Furthermore, as best seen in FIG. 3, first respective radiating arm 411 extends from side-to-side of face 203 at respective end 221 of face 203 and further wraps around to edge 225, each of the at least two further respective radiating arms 412, 413 extending from an edge portion of the first respective radiating arm 411. While only one edge portion of first respective radiating arm 411 is depicted in FIG. 3, it is appreciated that an opposite end of first respective radiating arm 411 also wraps around to edge 225. From both FIGS. 3 and 4, it can be seen that at least a portion of a perimeter of first respective radiating arm 411 has a shape similar to an end 221 of face 203. In other words, a shape of first respective radiating arm 411 follows a shape of face 203 so that first radiating arm 411 extends from side to side of face 203 and further has a shape similar to face 203 between end 221 and a gap between first respective radiating arm 411 and conducting central portion 230.

From FIGS. 3 and 4 it is further apparent that each of at least two further respective radiating arms 412, 413 extend from opposite ends of the first respective radiating arm 411, for example the ends that wrap around edge 225. Indeed, each of at least two further respective radiating arms 412, 413 extend towards each other from opposite ends of the first respective radiating arm 411, for example towards a longitudinal axis of device 101 and/or a centre of end 221.

In general, first respective radiating arm 411 is configured to resonate in a frequency range lower than respective frequency ranges of the at least two further respective radiating arms 412, 413. Hence first radiating arm 411 is longer than each of radiating arms 412, 413 and/or has a longer radiating length than each of radiating arms 412, 413. Furthermore, one of radiating arms 412, 413 can be longer than the other of radiating arms 412, 413 so that one of radiating arms 412, 413 resonates in a mid range frequency and the other of radiating arms 412, 413 resonates in higher frequency range.

As depicted, in a successful prototype, first radiating arm 411 has dimensions of about 70 mm long by about 13 mm wide at a widest portion, though a width of first radiating arm 411 varies with a shape of face 203; second radiating arm 412 has dimensions of about 30 mm long by about 4 mm wide; and third radiating arm 413 has dimensions of about 30 mm long by about 3 mm wide. Furthermore, device 101 has total length of about 140 mm, and gaps of about 1 mm between conducting central portion 230 and radiating arm 411. However, other dimensions and configurations that allow antenna 111 to resonate within at least three frequency ranges are within the scope of present implementations.

Structure of antenna 112 is next described with reference to FIG. 4, which depicts a perspective view of end 222 showing antenna 112 in detail, as well as dimensions of a successful prototype of antenna 112. In these implementations, back 201 comprises a plastic substrate with a thickness of about 6 mm at end 222 upon which antenna 112 is mounted. For example, antenna 112 can comprise one or morestrips and/or sheets of a conducting material mounted on the plastic substrate, the conducting material including, but not limited to metal, metal foil, copper, conducting plastic, conducting polymer and the like. The microstrips can be connected using solder, conducting paste and/or conducting glue and/or antenna 112 can have an integrated structure.

Furthermore, antenna 112 has a generally similar structure as antenna 111, antenna 111 comprising a first respective radiating arm 511, similar to radiating arm 411, and at least two further respective radiating arms 512, 513, similar to radiating arms 412, 413, though dimensions of each radiating arm 511, 512, 513 can be different from dimensions of corresponding radiating arm 411, 412, 413 as antenna 112 is in a different electrical environment than antenna 111 at least due to the absence of port 136 from end 222.

In any event, a first respective radiating arm 511 extends from side-to-side of face 203 at a respective end 222 of face 203. Furthermore, similar to radiating arm 411, first respective radiating arm 511 extends from side-to-side of face 203 at respective end 222 of face 203 and further wraps around to edge 225, each of the at least two further respective radiating arms 512, 513 extending from an edge portion of the first respective radiating arm 511. It is appreciated that each end of first respective radiating arm 511 wraps around to edge 225, as with antenna 111. It further be seen in FIG. 5 that at least a portion of a perimeter of first respective radiating arm 511 has a shape similar to an end 222 of face 203. In other words, a shape of first respective radiating arm 511 follows a shape of face 203 so that first radiating arm 511 extends from side to side of face 203 and further has a shape similar to face 203 between end 221 and a gap between first respective radiating arm 511 and conducting central portion 230.

From FIGS. 3 and 4 it is further apparent that each of at least two further respective radiating arms 512, 513 extend from opposite ends of the first respective radiating arm 511, for example the ends that wrap around edge 225. Indeed, each of at least two further respective radiating arms 512, 513 extend towards each other from opposite ends of the first respective radiating arm 511, for example towards a longitudinal axis of device 101 and/or a centre of end 221.

In general, first respective radiating arm 511 is configured to resonate in a frequency range lower than respective frequency ranges of the at least two further respective radiating arms 512, 513. Hence first radiating arm 511 is longer than each of radiating arms 512, 513 and/or has a longer radiating length than each of radiating arms 512, 513. Furthermore, one of radiating arms 512, 513 can be longer than the other of radiating arms 512, 513 so that one of radiating arms 512, 513 resonates in a mid range frequency and the other of radiating arms 512, 513 resonates in higher frequency range.

As depicted, in a successful prototype, first radiating arm 511 has dimensions of about 70 mm long by about 10 mm wide at a widest portion, though a width of first radiating arm 511 varies with a shape of face 203; second radiating arm 512 has dimensions of about 35 mm long by about 4 mm wide; and third radiating arm 513 has dimensions of about 20 mm long by about 4 mm wide. Furthermore, device 101 has total length of about 140 mm, and gaps of about 1 mm between conducting central portion 230 and radiating arm 511. However, other dimensions and configurations that allow antenna 112 to resonate within at least three frequency ranges are within the scope of present implementations.

In any event, each antenna 111, 112 is configured to resonate in three different frequency ranges. For example, a first respective radiating arm 411, 511 of each antenna 111, 112 is configured to resonate in one or more of: a frequency range of about 698 MHz to about 960 MHz; an LTE (Long-Term Evolution) frequency range; and LTE700 frequency range. A respective radiating arm 412, 512 of each antenna 111, 112 is configured to resonate in one or more of: a frequency range of about 1710 to about 2100 MHz, a GSM (Global System for Mobile Communications) frequency range; a CDMA (Code Division Multiple Access) frequency range; a PCS (Personal Communications Service) frequency range; and a UMTS (Universal Mobile Telecommunications System) frequency range. And, a respective radiating arm 413, 513 of each antenna 111, 112 is configured to resonate in one or more of: a frequency range of about 2300 to about 2700 MHz, another GSM (Global System for Mobile Communications) frequency range; another CDMA (Code Division Multiple Access) frequency range; another PCS (Personal Communications Service) frequency range; and another UMTS (Universal Mobile Telecommunications System) frequency range.

Put another way, a first one of the at least three frequency ranges comprises one or more of: a frequency range of about 698 MHz to about 960 MHz; an LTE (Long-Term Evolution) frequency range; and LTE700 frequency range; a second one of the at least three frequency ranges comprises one or more of: about 1710 to about 2100 MHz, a GSM (Global System for Mobile Communications) frequency range; a CDMA (Code Division Multiple Access) frequency range; a PCS (Personal Communications Service) frequency range; and a UMTS (Universal Mobile Telecommunications System) frequency range; and, a third one of the at least three frequency ranges comprises one or more of: about 2300 to about 2700 MHz, another GSM (Global System for Mobile Communications) frequency range; another CDMA (Code Division Multiple Access) frequency range; another PCS (Personal Communications Service) frequency range; and another UMTS (Universal Mobile Telecommunications System) frequency range.

In general, performance of antennas 111, 112 can be measured using efficiency measurements as a function of frequency for different use cases including, but not limited to free space total efficiency and free space radiation efficiency of device 101 (in general, total efficiency is the radiation efficiency plus losses for mismatch), device 101 being held in a left hand or a right hand away from a head, and device 101 being held in left hand or right hand beside a head.

In present implementation, the efficiency of the successful prototype was measured in various use situations. Using such measurements, antenna selection table 146 can be populated. For example, attention is next directed to FIG. 6, which depicts a non-limiting implementation of an antenna selection table 146. However, while the depicted antenna selection table 146 is organized in a table format, and/or in rows and columns, in other implementations, antenna selection table 146 can be organized in any other format accessible to processor 120 to determine which antenna 111, 112 to select. Specifically, antenna selection table 146 depicts free space ("FS") efficiency for each of antenna 111 ("Ant1") and antenna 112 ("Ant2") in various frequency ranges, as well as left hand, beside head ("LHH") efficiencies, determined from measured efficiency.

In any event, antenna selection table 146 depicts, for each indicated frequency range, an average measured efficiency in the frequency range for each of antenna 111, 112, in decibels, cable losses in each frequency range (about 1 decibel), and an antenna requirement in decibels in each frequency range, as well as which antenna to select in each frequency range and in each situation (i.e. either free space or "LHH"). To determine which antenna to select, the losses are subtracted from each of the efficiency measurements for each of antenna 111, 112. When the total efficiency for a given antenna 111, 112 is greater than the requirement value, and/or within a given range of the requirement value (e.g. +/− about 0.5) the given antenna can be selected for use in that frequency range. When both antennas 111, 112 meet the requirement value, or alternatively both antennas 111, 112 fail the requirement value, then either of antennas 111, 112 can be selected. For example, in the frequency range of 698-790 MHz, the respective free space efficiencies of antennas 111, 112 are −3 and −5; subtracting the 1 decibel loss from these values results in respective values of −4 and −6. As −4 is above the requirement value of −5, antenna 111 can be selected for use in this frequency range, and as −6 is below the requirement value of −5, antenna 112 is not selected for use.

In any event processor 120 can determine which frequency range is in use, further determine which use situation applies (e.g. left hand, right hand, beside head, free space etc. based on sensor readings and the like) and use switch 115 to select one or more of antennas 111, 112 for operation. Furthermore, such selection can be based on whether device is in an uplink mode (i.e. data being uploaded from device 101 to a network) or a downlink mode (i.e. data being downloaded to device 101 from the network). When in an uplink mode, only one of antennas 111, 112 is selected, while in a downlink mode, both of antennas 111, 112 can be selected. Hence, switch 115 can be configured to select one or more of first antenna 111 and second antenna 112 for operation and/or transmission operation. In yet further implementations, switch can be configured to change one or more of antennas 111, 112 from an on-state to an off-state and/or from an off-state to an on-state; e.g. when a selected/current/on antenna 111, 112 is de-tuned because of environmental/human effects, then switch 115 can de-select and/or urn off that antenna 111, 112 and select and/or turn on the other antenna 111, 112.

It is further appreciated that SAR (specific absorption rate) can also be measured and used to populate antenna selection table. In other words, when SAR is above a given threshold for a given antenna 111, 112 in a given frequency range and/or a given use situation, the given antenna 111, 112 can be prevented from operating in order to minimize user exposure to radiation.

Furthermore, while antenna selection table 146 depicted in FIG. 6 shows the efficiency values for each of antennas 111, 112 in each frequency range, and losses for each, antenna selection table 146 can more simply comprise an indication of which of antennas 111, 112 to use in each frequency range without storing the efficiency values.

In any event, described herein are examples devices with tri-band antennas incorporated into a back and along an edge of the devices.

Those skilled in the art will appreciate that in some implementations, the functionality of device 101 can be implemented using pre-programmed hardware or firmware elements (e.g., application specific integrated circuits (ASICs), electrically erasable programmable read-only memories (EEPROMs), etc.), or other related components.

In other implementations, the functionality of device 101 can be achieved using a computing apparatus that has access to a code memory (not shown) which stores computer-readable program code for operation of the computing apparatus. The computer-readable program code could be stored on a computer readable storage medium which is fixed, tangible and readable directly by these components, (e.g., removable diskette, CD-ROM, ROM, fixed disk, USB drive). Furthermore, it is appreciated that the computer-readable program can be stored as a computer program product comprising a computer usable medium. Further, a persistent storage device can comprise the computer readable program code. It is yet further appreciated that the computer-readable program code and/or computer usable medium can comprise a non-transitory computer-readable program code and/or non-transitory computer usable medium. Alternatively, the computer-readable program code could be stored remotely but transmittable to these components via a modem or other interface device connected to a network (including, without limitation, the Internet) over a transmission medium. The transmission medium can be either a non-mobile medium (e.g., optical and/or digital and/or analog communications lines) or a mobile medium (e.g., microwave, infrared, free-space optical or other transmission schemes) or a combination thereof.

A portion of the disclosure of this patent document contains material which is subject to copyright protection. The copyright owner has no objection to the facsimile reproduction by any one of the patent document or patent disclosure, as it appears in the Patent and Trademark Office patent file or records, but otherwise reserves all copyrights whatsoever.

Persons skilled in the art will appreciate that there are yet more alternative implementations and modifications possible, and that the above examples are only illustrations of one or more implementations. The scope, therefore, is to be limited by the claims appended here.

What is claimed is:

1. A device comprising:

a back side comprising a face;

a first end, and a second end opposite the first end;

an edge extending from the face, the edge encircling the face and having (i) respective opposing end surfaces at the first end and the second end, and (ii) opposing side surfaces joined between the end surfaces by corner portions of the edge;

a conducting central portion located externally on the face;

a first antenna located externally at the first end and electrically separated from the conducting central portion by a first gap extending across the face between the side surfaces of the edge;

a second antenna located externally at the second end and electrically separated from the conducting central portion by a second gap extending across the face between the side surfaces of the edge, and each of the first antenna and the second antenna comprising:

a first respective radiating arm having:

a face portion covering an area of the face bounded by the respective gap, the end surface at a respective end, and the side surfaces; and at least two edge portions wrapping from the face portion around to the side surfaces of the edge and to the corner portions of the edge, and at least two further respective radiating arms extending from respective edge portions of the first respective radiating arm towards each other along the respective end surface, the first respective radiating arm and the at least two further respective radiating arms configured to resonate in at least three frequency ranges;

one or more antenna feeds connected to each of the first antenna and the second antenna, and electrically separated from the conducting central portion; and, a switch configured to select one or more of the first antenna and the second antenna for operation.

2. The device of claim 1, wherein each of the conducting central portion, the first antenna and the second antenna comprises one or more metals.

3. The device of claim 1, wherein each of the first antenna and the second antenna comprises one or more metals.

4. The device of claim 1, wherein the back side comprises one or more of an entire metal piece and a predominantly metal piece, forming each of the conducting central portion, the first antenna and the second antenna, with each of the conducting central portion, the first antenna and the second antenna separated by one or more non-conducting materials.

5. The device of claim 1, wherein the back side further comprises a non-conducting chassis, the conducting central portion comprising a conducting sheet attached to the non-conducting chassis, the first antenna and the second antenna each comprising one or more respective microstrips on the non-conducting chassis.

6. The device of claim 1, wherein each of the first antenna and the second antenna further comprise: a first respective connection to the one more antenna feeds; and a second respective connection to a ground plane.

7. The device of claim 1, further comprising one or more antenna shorting-to-ground pins connected to each of the first antenna and the second antenna.

8. The device of claim 1, further comprising a port through an end of the device adjacent the first antenna, the first antenna clearing the port.

9. The device of claim 1, further comprising a memory storing an antenna selection table, and the switch is further configured to select one or more of the first antenna and the second antenna for operation based upon the antenna selection table.

10. The device of claim 1, wherein the switch is further configured to select one or more of the first antenna and the second antenna for transmission operation.

11. The device of claim 1, wherein the conducting central portion covers about 80% of the back side.

12. The device of claim 1, wherein the first respective radiating arm is configured to resonate in a frequency range lower than respective frequency ranges of the at least two further respective radiating arms.

13. The device of claim 1, wherein the first respective radiating arm is configured to resonate in one or more of: a frequency range of about 698 MHz to about 960 MHz; an LTE (Long-Term Evolution) frequency range; and LTE700 frequency range.

14. The device of claim 1, wherein:

a first radiating arm of the at least two further respective radiating arms is configured to resonate in one or more of: a frequency range of about 1710 to about 2100 MHz, a GSM (Global System for Mobile Communications) frequency range; a CDMA (Code Division Multiple Access) frequency range; a PCS (Personal Communications Service) frequency range; and a UMTS (Universal Mobile Telecommunications System) frequency range; and, a second radiating arm of the at least two further respective radiating arms is configured to resonate in one or more of: a frequency range of about 2300 to about 2700 MHz, another GSM (Global System for Mobile Communications) frequency range; another CDMA (Code Division Multiple Access) frequency range; another PCS (Personal Communications Service) frequency range; and another UMTS (Universal Mobile Telecommunications System) frequency range.

15. The device of claim 1, wherein:

a first one of the at least three frequency ranges comprises one or more of: a frequency range of about 698 MHz to about 960 MHz; an LTE (Long-Term Evolution) frequency range; and LTE700 frequency range;

a second one of the at least three frequency ranges comprises one or more of: about 1710 to about 2100 MHz, a GSM (Global System for Mobile Communications) frequency range; a CDMA (Code Division Multiple Access) frequency range; a PCS (Personal Communications Service) frequency range; and a UMTS (Universal Mobile Telecommunications System) frequency range; and, a third one of the at least three frequency ranges comprises one or more of: about 2300 to about 2700 MHz, another GSM (Global System for Mobile Communications) frequency range; another CDMA (Code Division Multiple Access) frequency range; another PCS (Personal Communications Service) frequency range; and another UMTS (Universal Mobile Telecommunications System) frequency range.

* * * * *